US008961194B2

(12) United States Patent
Ye

(10) Patent No.: US 8,961,194 B2
(45) Date of Patent: Feb. 24, 2015

(54) ACTIVE HDMI CONNECTOR WITH INTEGRATED DESIGN

(71) Applicant: Daowu Ye, Shenzhen (CN)

(72) Inventor: Daowu Ye, Shenzhen (CN)

(73) Assignee: BBY Solutions, Inc., Richfield, MN (US)

( * ) Notice: Subject to any disclaimer, the term of this patent is extended or adjusted under 35 U.S.C. 154(b) by 5 days.

(21) Appl. No.: 13/802,973

(22) Filed: Mar. 14, 2013

(65) Prior Publication Data

US 2014/0273636 A1 Sep. 18, 2014

(51) Int. Cl.

| | |
|---|---|
| ***H01R 12/00*** | (2006.01) |
| ***H01R 13/66*** | (2006.01) |
| ***H01R 24/28*** | (2011.01) |

(52) U.S. Cl.

CPC ..... *H01R 13/66* (2013.01); *H01R 24/28* (2013.01)

USPC ..... 439/69

(58) Field of Classification Search

USPC ..... 439/607.01, 607.55, 69, 620.15

See application file for complete search history.

(56) References Cited

U.S. PATENT DOCUMENTS

| | | | | |
|---|---|---|---|---|
| 7,320,604 | B2 * | 1/2008 | Ohtsuki | 439/69 |
| 7,682,194 | B2 * | 3/2010 | Lin et al. | 439/607.31 |
| 8,262,411 | B2 * | 9/2012 | Kondo | 439/607.01 |
| 8,506,333 | B2 * | 8/2013 | Wang et al. | 439/626 |
| 8,562,369 | B2 * | 10/2013 | Wu | 439/345 |
| 2004/0115990 | A1 * | 6/2004 | Kodama | 439/607 |
| 2010/0068934 | A1 * | 3/2010 | Li et al. | 439/607.55 |
| 2011/0151716 | A1 * | 6/2011 | Kondo | 439/607.01 |
| 2012/0045920 | A1 * | 2/2012 | Wu | 439/345 |
| 2012/0322313 | A1 * | 12/2012 | Hsu et al. | 439/629 |

* cited by examiner

*Primary Examiner* — Chandrika Prasad
(74) *Attorney, Agent, or Firm* — Beck & Tysver PLLC

(57) ABSTRACT

An integrated design for an active HDMI connector is presented. The active HDMI connector comprises an active module circuit board, a connector pin assembly, connector pins, an insulation housing, and a metal connector shell. The connector shell partially encloses and partially exposes the active module. The connector pins each have a bent segment embedded in a molding assembly to fixate the pins within the molding assembly. The molding assembly defines a recessed slot for the active module. The active module has a cutout on a side of the module that is aligned with a tab on the connector shell. The tab is bent toward the inside of the connector shell to secure the active module inside the shell. The insulation housing includes pin separators that do not fully surround the connector pins.

13 Claims, 8 Drawing Sheets

Fig.1
*PriorArt*
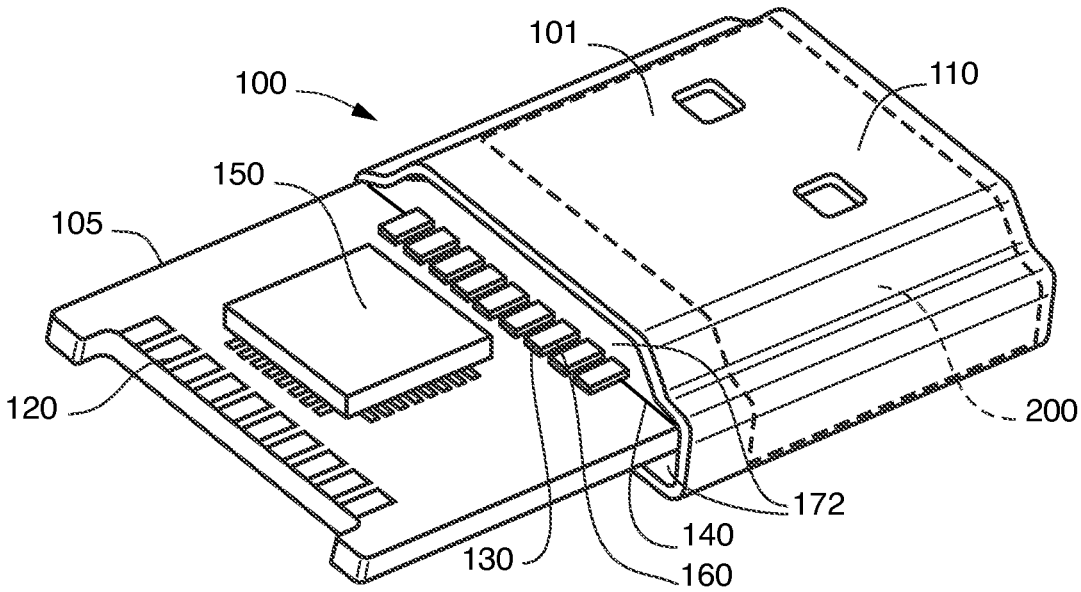
Fig.2
*PriorArt*
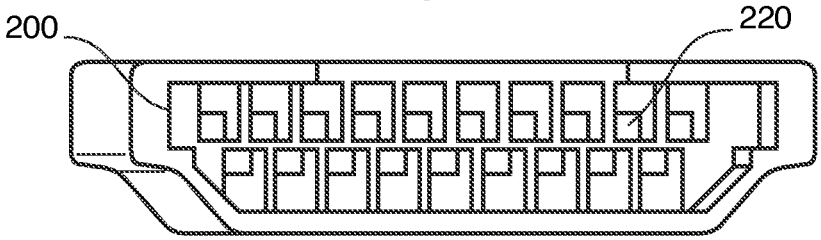

ACTIVE HDMI CONNECTOR WITH INTEGRATED DESIGN

FIELD OF THE INVENTION

The present application relates to the field of HDMI data connectors. More particularly, the described embodiments relate to an active HDMI connector with an integrated connector and active module.

BACKGROUND

A high-definition multimedia interface cable (HDMI cable) can relay compressed or uncompressed video and audio data from a data source, such as a computer or media player, to a video and audio output device. A standard HDMI cable comprises a connector pin assembly soldered directly to cable wires. When a data signal is transferred through an ultra-thin HDMI cable or a long HDMI cable, there can be significant signal attenuation. If there is too much signal loss, the cable will be unable to meet the high HDMI data transfer rate standards. This problem has been addressed by adding an active module chipset to the connector pin assembly. The chipset boosts the HDMI data signal and equalizes the signal at the end of the cable to compensate for signal attenuation.

FIG. 1 shows a prior art active HDMI connector assembly 100, which is provided in two parts. The first part of the connector assembly 100 is an active module circuit board 105 with an active chipset 150 to boost the HDMI data signal though the HDMI cable. The second part of the connector assembly 100 is a connector body 101 comprising a metal connector shell 110 enclosing a connector pin assembly 172 with connector pins 160 protruding from the assembly 172. The connector shell 110 also encloses an insulation housing 200 that houses the pin assembly 172 and the connector pins 160. The active module 105 is entirely exposed outside of shell 110. The active module 105 abuts the connector pin assembly 172, and the connector pins 160 are soldered to pin contacts 130 on the abutting end 140 of active module 105. Cable contacts 120 on the opposite end of active module 105 can be soldered to cable conductor wires.

FIG. 2 shows a cross-section of insulation housing 200, which surrounds the connector pin assembly 172 inside of shell 110. The insulation housing 200 has a grid of pin separators 220 to protect and electrically isolate connector pins 160. Each individual connector pin 160 is separated from other pins 160 inside the insulation housing 200 by the pin separators 220.

BRIEF DESCRIPTION OF THE DRAWINGS

FIG. 1 is a schematic view of a prior art HDMI connector assembly.

FIG. 2 is a perspective view of a prior art insulation housing.

DETAILED DESCRIPTION

Figure 3:
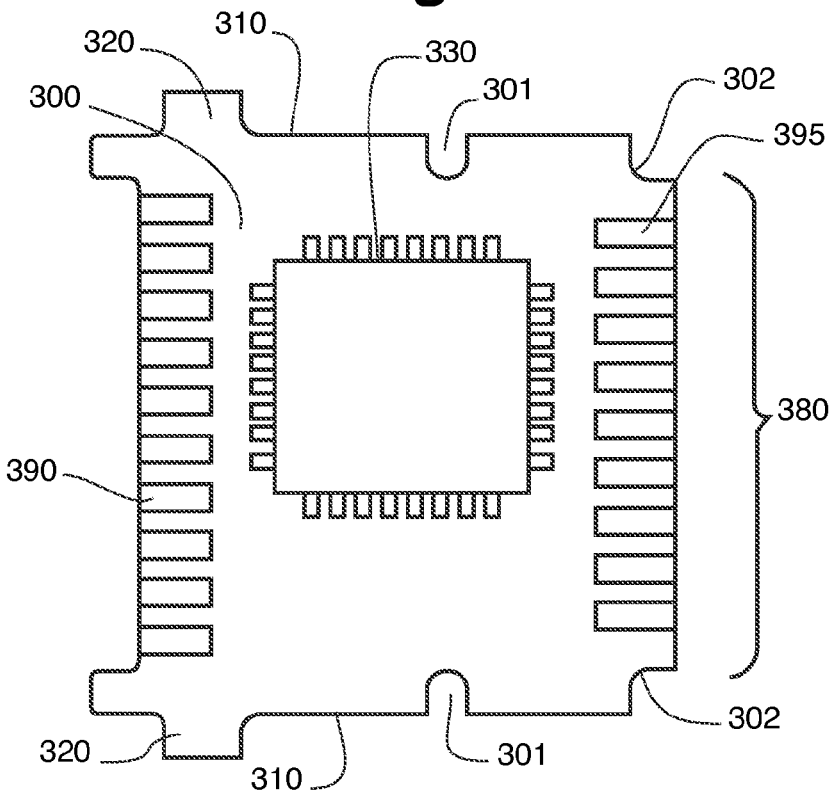
FIG. 3 is a schematic view of an active module for an integrated HDMI connector assembly.
Figure 4:
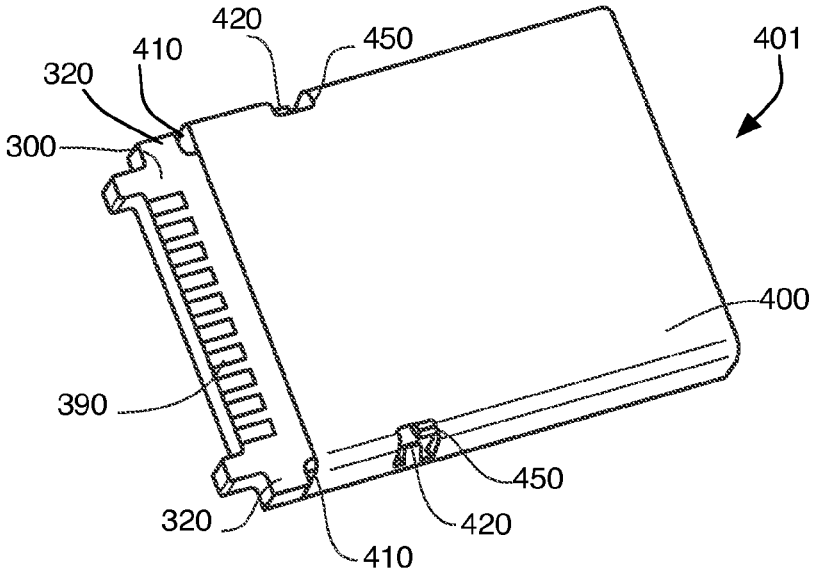
FIG. 4 is a perspective view of an active HDMI connector assembly with integrated design.
Figure 5:
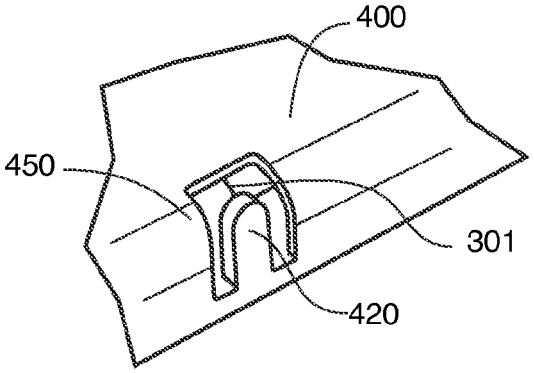
FIGS. 5 and 6 are perspective views of a tab for use with the integrated HDMI connector assembly.
Figure 6:
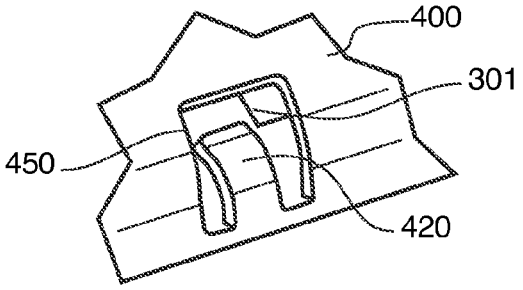

FIGS. 3-6 show one embodiment of an integrated active HDMI connector assembly 401. As shown in FIG. 4, the integrated active HDMI connector assembly 401 includes an active module circuit board 300 that is partially enclosed inside of a connector shell 400 and partially exposed outside of the shell 400. The module 300, more clearly shown in FIG. 3, has cable contacts 390 that can be soldered to cable conductor wires, and pin contacts 395 that can be soldered to connector pins. When assembled, the HDMI connector assembly 401 encloses the active chipset 330 on the active module 300, providing improved electromagnetic interference (EMI) shielding.

The disclosed embodiments of the integrated HDMI connector provide a manufacturing advantage. The prior art active HDMI connector assembly 100 shown in FIG. 1 is provided in two parts: an active module 105 and a connector body 101. A cable manufacturer solders the connector body 101 to the active module 105, and solders cable wires to cable contacts 120 on the module 105. The integrated active HDMI connector assembly 401 disclosed herein provides the assembly 401 as a single unit, requiring the cable manufacturer to solder only once between the connector cable wires and cable contacts 390.

The active module 300 contains a number of features that allow the module 300 to be secured in the shell 400. The sides 310 of the module 300 contain cutouts 301. The cutouts 301 are positioned to mechanically secure module 300 within shell 400 through the use of a tab 420 formed into the shell 400. The shell 400 contains a cutout 450 providing access to an interior of shell 400. After module 300 is inserted into the shell 400, the tab 420 is bent inward toward the interior of shell 400 to align with the cutout 301 as in FIG. 6. The tab 420 prevents the module 300 from sliding into or out of the shell 400.

Module 300 has two shoulders 320 extending outward from the sides 310 of module 300. When the active HDMI connector assembly 401 is assembled, the module 300 partially protrudes from the shell 400. The shoulders 320 abut the side edge 410 of shell 400, which prevents the cable contacts 390 of module 300 from sliding into the shell 400. Note that the shell 400 does surround the active chipset 330 on module 300, which provides enhanced EMI shielding for the chipset 330.

Figure 7:
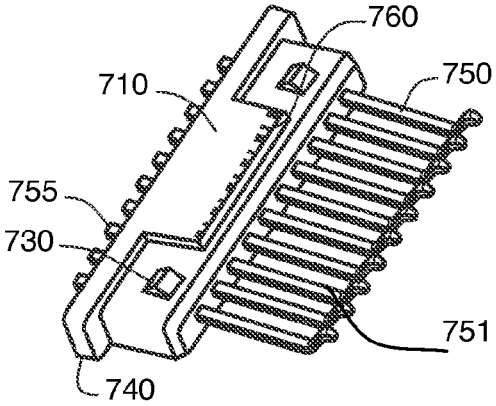
FIGS. 7 and 8 are perspective views of a first molding assembly for the HDMI connector.
Figure 8:
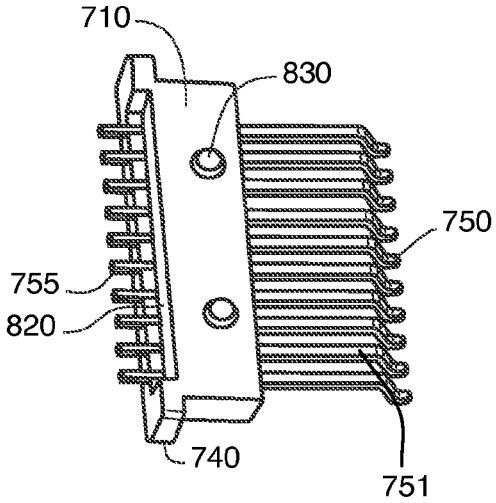
Figure 9:
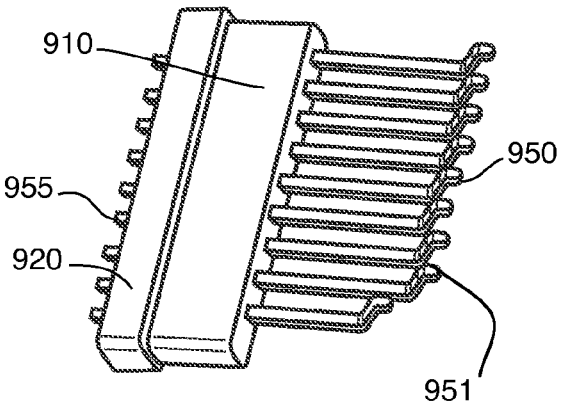
FIGS. 9 and 10 are perspective views of a second molding assembly for the HDMI connector.
Figure 10:
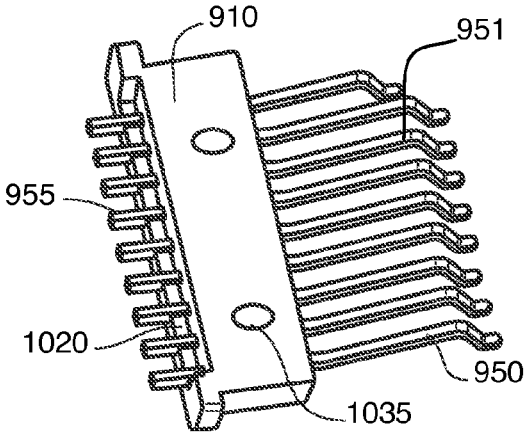
Figure 11:
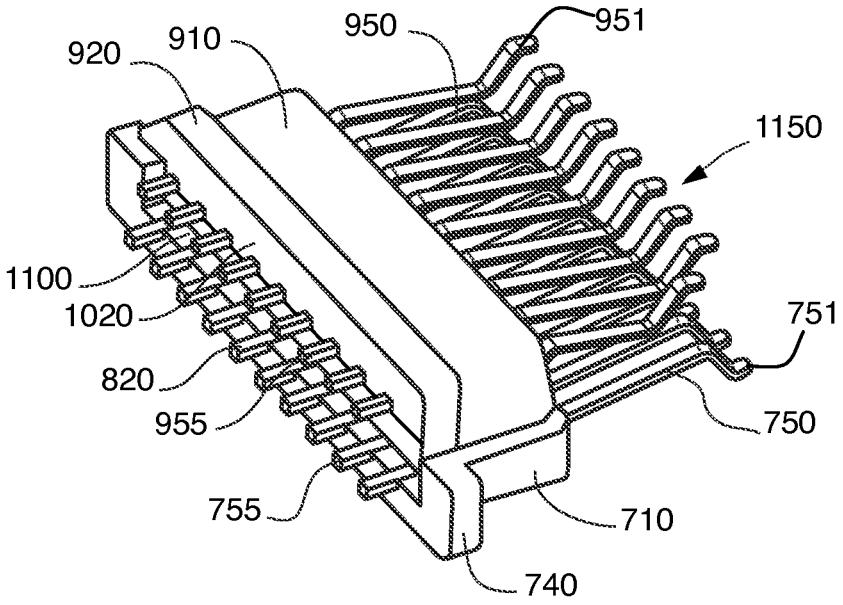
FIG. 11 is a perspective view of a connector pin assembly.

FIGS. 7-11 show perspective views of molding assemblies used to hold the contact pins in the HDMI connector assembly 401. FIGS. 7-8 show a top and bottom side, respectively, of a 10-pin molding assembly 710. FIGS. 9-10 show a bottom and top side, respectively of a 9-pin molding assembly 910. FIG. 11 shows the molding assemblies 710, 910 coupled to form a connector pin assembly 1150.

In FIGS. 7-8, the 10-pin molding assembly 710 has contact pins 750 that are partially embedded in the molding assembly 710. The pins 750 provide electrical data connection when the HDMI connector assembly 401 is plugged into a data source. The contact pins 750 have a distal end portion 751 that extends out of the molding assembly 710 and a proximal end portion 755 that protrudes from the molding assembly 710 into a recess 820 found on the bottom side of the molding assembly 710. The proximal end portions 755 will be connected to the active HDMI module 300 in the active HDMI connector assembly 401.

Molding assembly 710 also has features to mechanically secure the molding assembly 710 to other parts in the connector assembly 401. A protrusion 830 on the bottom side of the molding assembly aligns the molding assembly 710 with a top side of a second molding assembly 910. A protrusion 730, a protruding wall 760, and a shoulder 740 help secure the molding assembly 710 within an insulation housing 1310 shown in FIGS. 13-14.

In FIGS. 9-10, the 9-pin molding assembly 910 has contact pins 950 that are partially embedded in the molding assembly 910. The contact pins 950 have a distal end portion 951 that extends out of the molding assembly 910 and a proximal end portion 955 that protrudes from the molding assembly 910 into a recess 1020 found on the top side of the molding assembly 910. The proximal end portions 955 will be connected to the active HDMI module 300 in the active HDMI connector assembly 401.

Molding assembly 910 also has features to mechanically secure the molding assembly 910 to other parts in the connector assembly 401. One or more notches 1035 on the top side of the molding assembly 910 align with the protrusions 830 on the bottom side of molding assembly 710 to lock the molding assemblies 710, 910 together. An abutting edge 920 helps secure the molding assembly 910 in the insulation housing 1310.

FIG. 11 shows the molding assemblies 710, 910 coupled together to create a connector pin assembly 1150. When coupled, the recess 820 on the bottom of assembly 710 neighbors the recess 1020 on the top of assembly 910. Together, the recesses 820, 1020 define a slot 1100. The slot 1100 is sized to receive an edge 380 of the active module 300.

Figure 12:
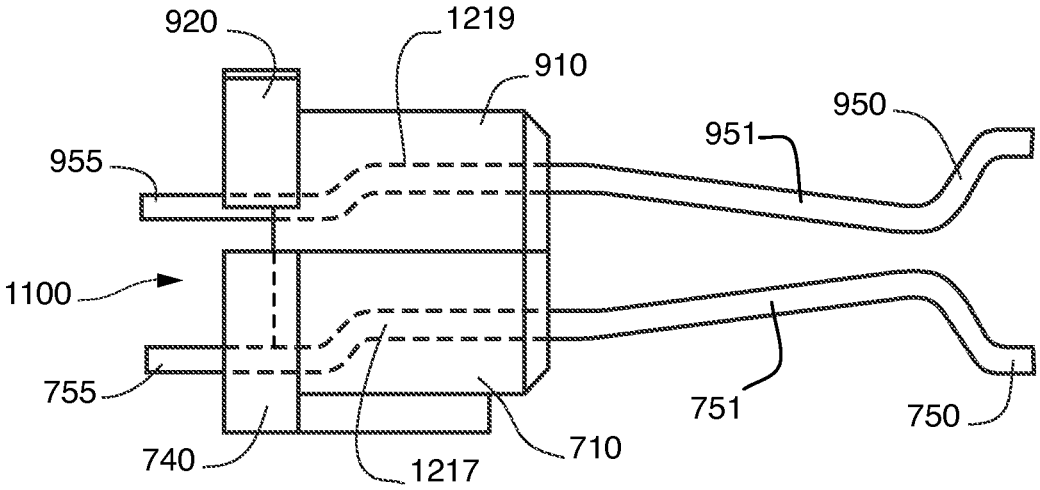
FIG. 12 is a schematic view of a pin fixation construction.

FIG. 12 is a schematic side view of the connector pin assembly 1150 showing fixation of the connector pins 750, 950 within the molding assemblies 710, 910. The pins 750, 950 have bent segments 1217 and 1219 that are partially embedded in molding assemblies 710, 910. The bent segments 1217, 1219 fix the contact pins within the molding assemblies 710, 910 by resisting any force attempting to pull the pins 750, 950 linearly out of the molding assemblies 710, 910.

Figure 13:
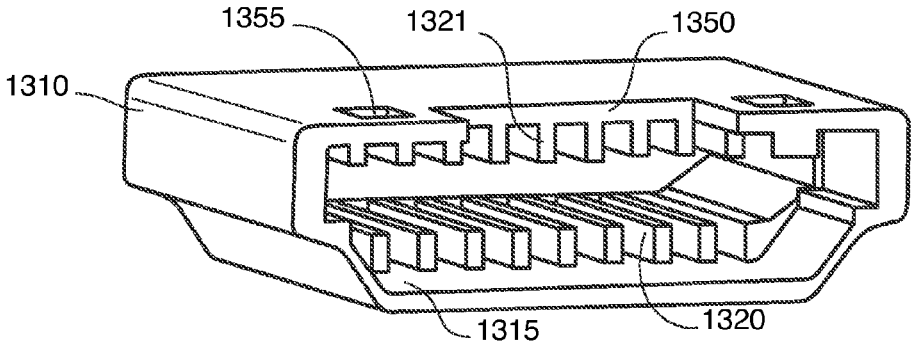
FIG. 13 is a perspective view of an insulation housing for the connector pin assembly.
Figure 14:
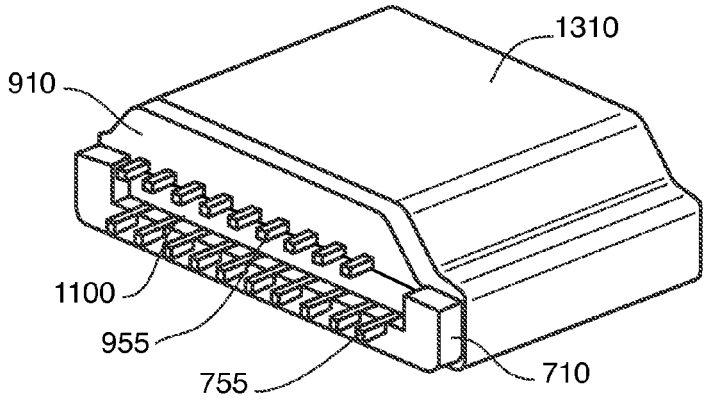
FIG. 14 is a perspective view of the insulation housing in combination with the connector pin assembly.

FIGS. 13-14 show an insulation housing 1310 that houses the connector pin assembly 1150. When the connector pin assembly 1150 is fully inserted into an opening 1315 of the housing 1310, the 10-pin molding assembly 710 is secured in the housing 1310 by the protrusion 730 fitting into a notch 1355 of the housing 1310. The protruding wall 760 abuts an edge of a cutout 1350 in the housing 1310. Housing assembly contains pin separators 1320 and 1321. When the connector pin assembly 1150 is coupled with the housing 1310, the top pin separators 1321 separate the pins 750 of the 10-pin molding assembly 710, and the bottom pin separators 1320 separate the pins 950 of the 9-pin molding assembly 910. FIG. 14 shows the insulation housing 1310 coupled with the connector pin assembly 1150.

The insulation housing 1310 of FIG. 13 differs from the prior art insulation housing 200 of FIG. 2 because pin separators 1321, 1320 are open-ended. In other words, the top and bottom pin separators 1321, 1320 do not touch and to not run in-between the pins 750, 950 of the two molding assemblies 710, 910. The prior art housing 200 contains a grid of pin separators 220, but the improved integrated, shortened design of the disclosed embodiments do not require each pin 750, 950 to be completely surrounded by the pin separators 1321, 1320.

Figure 15:
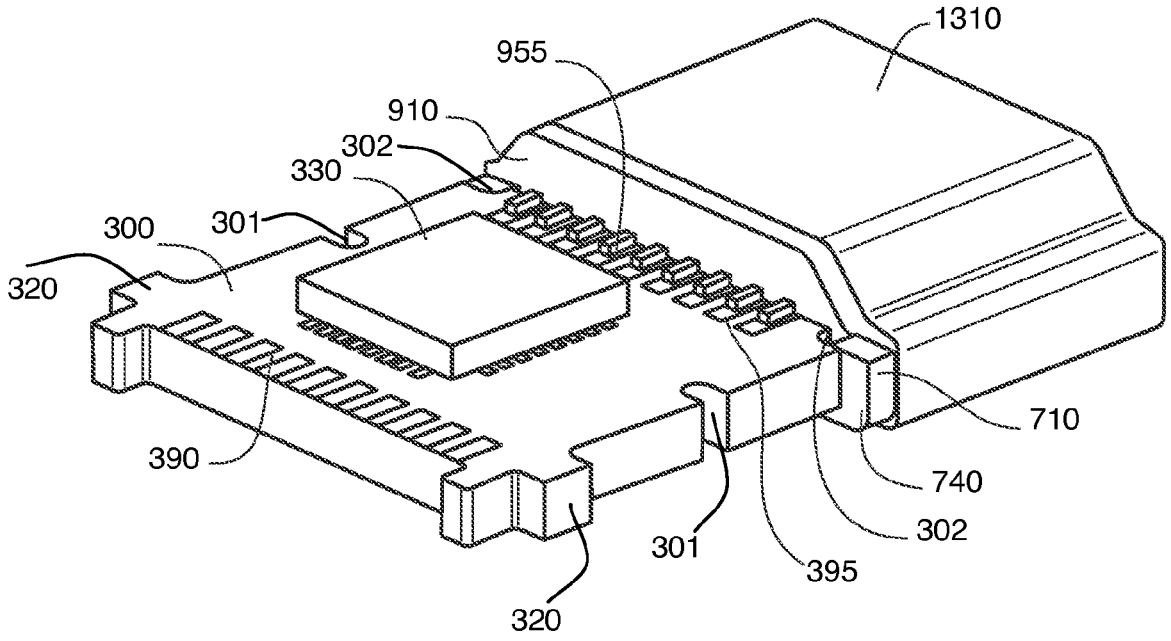
FIG. 15 is a perspective view of the active module coupled with the insulation housing and connector pin assembly.

FIG. 15 shows the integration of the connector pin assembly 1150, the insulation housing 1310, and the active module 300. The cutout 302 of module 300 abuts the shoulder 740 of molding assembly 710 and allows the narrow edge 380 of active module 300 to extend into the interior of slot 1100. The pin contacts 395 align with proximal pin end portions 955 in the integrated configuration when the edge 380 is within slot 1100. Proximal pin end portions 755 also connect to pin contacts (not shown) on an underside of the active module 300. As shown in FIG. 4, the shell 400 wraps around the insulation housing 1310 and the majority of the active module 300, exposing only shoulder portions 320 and the cable contacts 390 of module 300.

The integrated active HDMI connector configurations shown in FIGS. 4 and 15 allow the active HDMI connector assembly 401 to be physically shorter than the prior art connector assembly 100 of FIG. 1 (although, notably, the shell 400 is longer than the shell 110). Currently, an active HDMI connector assembly 100 can be as short as 23.3 mm. The integrated active HDMI connector assembly 401 disclosed herein can reduce the length of the active HDMI connector assembly 401 to as little as 18.3 mm.

Figure 16:
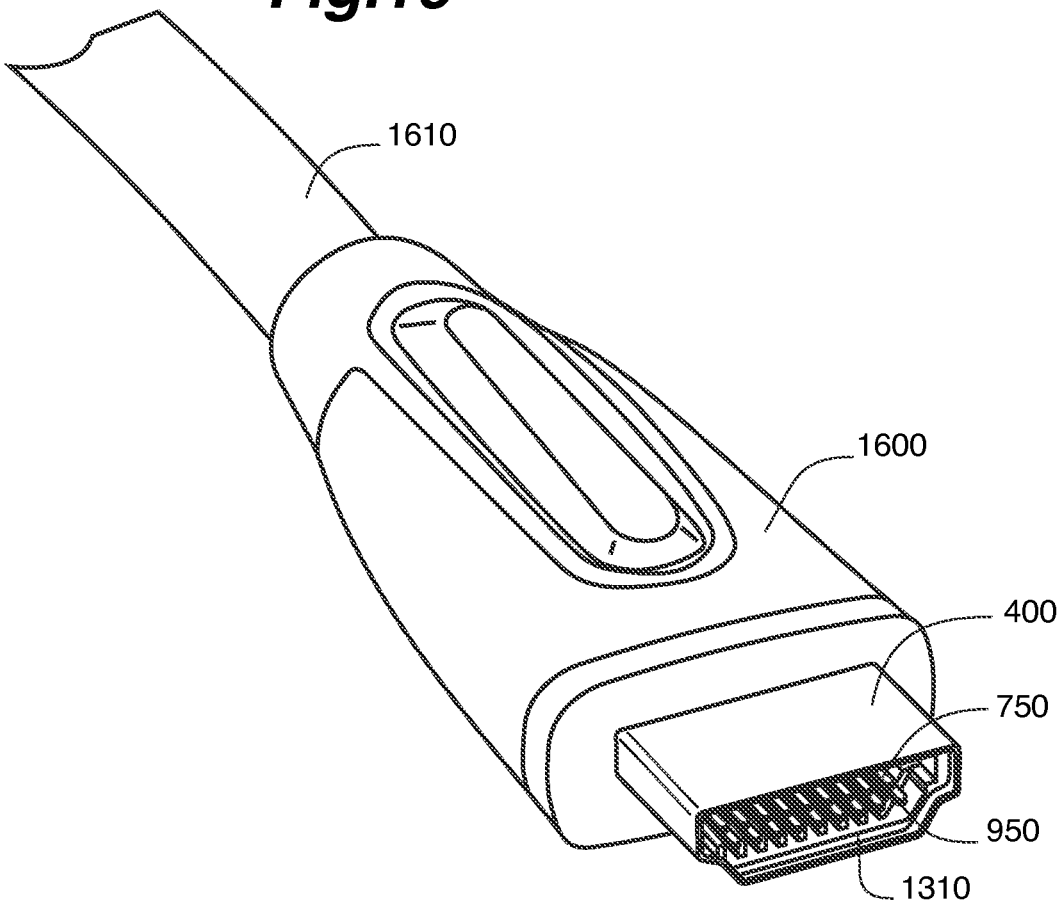
FIG. 16 is a perspective view of an active HDMI connector encased in a plug body.

FIG. 16 shows the HDMI connector assembly 401 used in an HDMI cable 1610. An insulating plug body 1600 surrounds the shell 400, which in turn houses the insulation housing 1310 and contact pins 750, 950.

The many features and advantages of the invention are apparent from the above description. Numerous modifications and variations will readily occur to those skilled in the art. For example, instead of two separate molding assemblies, the connector pin assembly could be provided as a single molding assembly containing both the 9-pin and 10-pin connectors. Since such modifications are possible, the invention is not to be limited to the exact construction and operation illustrated and described. Rather, the present invention should be limited only by the following claims.

What is claimed is:

1. An active high-definition multimedia interface (HDMI) connector comprising:

a) an active module circuit board having i) a plurality of pin contacts on a distal edge, ii) a plurality of cable contacts on a proximal edge opposite the distal edge, and iii) an active chipset that is mounted on the circuit board and that, when it receives an incoming HDMI data signal, boosts and outputs the data signal, wherein the HDMI data signal travels between the pin contacts and the cable contacts; and b) a metal connector shell surrounding the chipset and the distal edge and interior of the circuit board, but exposing the proximal edge.

2. The connector of claim 1, wherein the circuit board further comprises a shoulder adjacent to the proximal edge and wherein the shoulder abuts a proximal edge of the connector shell.

3. The connector of claim 2, wherein the circuit board further comprises a side notch, and the connector shell further comprises a tab aligned with the notch, the tab securing the circuit board inside the connector shell.

4. The connector of claim 1, wherein the connector shell further surrounds an insulation housing containing a pin assembly, the pin assembly comprising:

a) a molding assembly; and b) a plurality of connector pins each having a proximal end protruding from the molding assembly, a bent segment embedded in the molding assembly, and a distal end protruding from the molding assembly;

wherein the pin contacts on the circuit board are affixed to respective proximal ends of the connector pins.

5. The connector of claim 4, wherein the molding assembly further comprises a recessed slot at the proximal end of the connector pins, and the distal edge of the circuit board extends into an interior of the recessed slot.

6. The connector of claim 5, wherein the connector shell is at least partially encased in a plug body for an HDMI cable.

7. A pin assembly for a data connector, the pin assembly comprising:

a) a first molding assembly having a first recess; and b) a first plurality of connector pins each having i) a first end segment protruding from the first molding assembly, ii) a middle segment embedded in the first molding assembly, the middle segment having a bent portion securing the connector pin within the first molding assembly, and iii) a second end segment protruding from the first molding assembly into the first recess; and c) a second molding assembly coupled with the first molding assembly, the second molding assembly having a second recess neighboring the first recess and defining a slot made up of the first and second recesses;

d) a second plurality of connector pins each having i) a first end segment protruding from the second molding assembly;

ii) a middle segment embedded in the second molding assembly, the middle segment having a bent portion securing the connector pin within the second molding assembly; and ii) a second end segment protruding from the second molding assembly into the second recess.

8. The pin assembly of claim 7, wherein the first and second molding assemblies are securely coupled by a molding assembly protrusion and a molding assembly notch.

9. The pin assembly of claim 7, further comprising:

c) an insulation housing surrounding the first and second molding assemblies and the first and second plurality of connector pins, the insulation housing having a plurality of open-ended pin separators separating the connector pins;

wherein the pin separators are characterized in that the pin separators do not fully surround individual connector pins.

10. A connector for an active high-definition multimedia interface (HDMI) cable, the connector comprising:

a) a first molding assembly having i) a first recess, and ii) first connector pins partially embedded in the first molding assembly and partially protruding into the first recess;

b) a second molding assembly adjoining the first molding assembly, the second molding assembly having a second recess adjacent to the first recess;

c) a slot defined by the first recess and the second recess; and d) an active HDMI module coupled with the first and second molding assemblies, the module having first pin contacts on a top surface of a circuit board, the module extending into the slot such that the first pin contacts align and contact the first connector pins.

11. The connector of claim 10, further comprising:

e) second pin contacts on a bottom surface of the module opposite the top surface;

f) second connector pins partially embedded in the second molding assembly and partially protruding into the second recess;

wherein the second pin contacts align and contact the second connector pins.

12. The connector of claim 11, further comprising:

a) an insulation housing partially enclosing the first and second molding assemblies; and b) a metal connector shell enclosing the insulation housing, the metal connector shell partially enclosing the active HDMI module and partially exposing the active HDMI module.

13. The connector of claim 12, wherein the metal connector shell and the active module are embedded in a insulating plug body for the HDMI connector cable.

* * * * *